United States Patent [19]

Palffy

[11] Patent Number: 4,641,752

[45] Date of Patent: Feb. 10, 1987

[54] HOLDER FOR HAMBURGERS AND THE LIKE

[76] Inventor: Janos Palffy, Asköviksvägen 4, 725 92 Västerås, Sweden

[21] Appl. No.: 737,471

[22] Filed: May 24, 1985

[30] Foreign Application Priority Data

May 25, 1984 [SE] Sweden ..... 8402838

[51] Int. Cl.[4] ..... B65D 81/02; A21D 10/02

[52] U.S. Cl. ..... 206/583; 206/525; 426/110; 426/115; 229/87 F

[58] Field of Search ..... 206/583, 525; 426/110, 426/115; 229/DIG. 13, 3, 87 F

[56] References Cited

U.S. PATENT DOCUMENTS

| | | | |
|---|---|---|---|
| 2,811,246 | 10/1957 | Sloane | 206/583 |
| 3,853,220 | 12/1974 | Luray | 206/583 |
| 4,019,637 | 4/1977 | Kurtz | 206/583 |
| 4,345,687 | 8/1982 | Davidson | 206/583 |

*Primary Examiner*—Joseph Man-Fu Moy
*Attorney, Agent, or Firm*—Finnegan, Henderson, Farabow, Garrett & Dunner

[57] ABSTRACT

A holder for hamburgers and the like comprises a container (1) with downwardly converging side walls (2a,2b) and a support means (8) for the hamburger (15) is vertically displaceably arranged thereon. The support means is resilient and substantially V-shaped in cross section and is manually operated by means of a pressure exerted upon the side walls (2a,2b) at a region below the hamburger. The support means further has resilient flaps (14a,14b) provided to snap into openings (5) in the upper part of the container to prevent said support means (8) from unintentionally leaving the container (1).

An embodiment for directly operating the support means is also described.

10 Claims, 4 Drawing Figures

HOLDER FOR HAMBURGERS AND THE LIKE

The present invention refers to a disposable holder for hamburgers and similar food products.

In street kitchens and similar sales units hamburgers and similar food products usually are delivered in a paper table-napkin or other simple envelope which primarily is intended to prevent direct contact with the hamburger or the like.

Since food products of the kind referred to usually also contain fluid stuffs such as dressing, catsup and mustard and frequently also cut onion, lettuce and the like there exists a very pronuounced risk for leakage and crumbling with contaimination of hands, clothings or surroundings as a consequence.

Especially under winter conditions when it would be desirable to consume the food in a heated car or in a room instead of outside in the chill the risk for contamination often is a suppressing factor against doing so.

The U.S. Pat. No. 3,481,458 describes a holder for hamburgers and the like. This holder is however complicated and expensive to manufacture since it comprises a rigid container, which in the bottom surface thereof has a threaded socket for a threaded handle which in the upper end thereof is shaped to a seat for a ball secured to the under side of a bottom which is displaceable by turning the threaded handle. Such a device is further bulky and unpractical in use and owing to the high production costs it is not suitable for mass production. The risk for leakage through the threaded socket cannot be neglected.

Thus-one of the objects of the invention has been to provide a holder which is simple in use, which permits consumption of for instance a hamburger with accessories examplified above without considerable risk of contamination and which can be produced at such low costs that it can be disposed with after use.

A further object has been to provide a holder which can be used to diminish the risk of contaimination and also as a package for transport.

To accomplish these and still further objects the invention has the characteristics of the claims.

The accompanying drawing illustrates by way of an example an embodiment of the invention.

Figure 1:
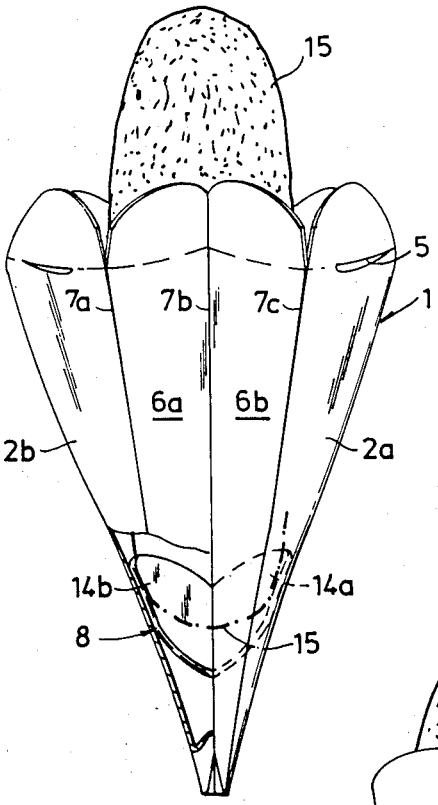
FIG. 1 is an end view, partly in section, of a holder made in accordance with the invention and with a hamburger resting against a support means movable in a container.
Figure 2:
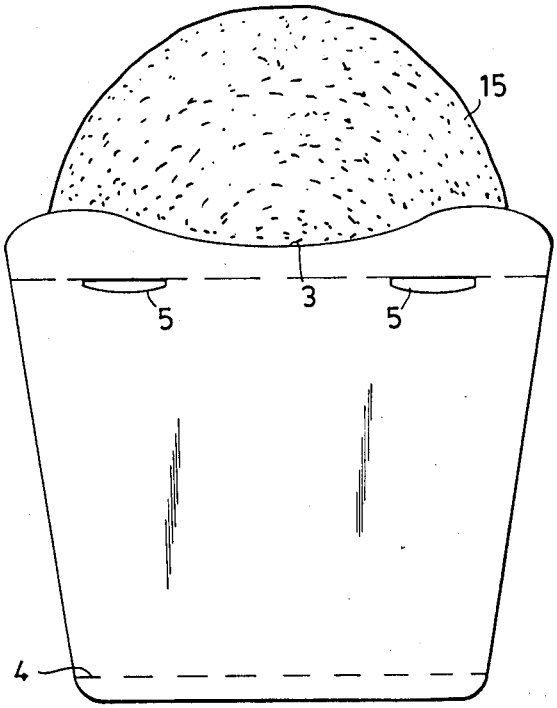
FIG. 2 shows the holder of FIG. 1 in a front view.

The holder illustrated in the drawings includes a container generally designated as 1, which according to the shown embodiment is manufactured from a planar blank of laminated cardboard, a rigid pvc sheet or the like, which by way of punching, folding and for instance plastic welding is shaped to a unit which is substantially flat. The container has a front wall 2*a* and a rear wall 2*b* and both walls have recesses 3 formed in the upper ends thereof for a purpose to be described. The front wall 2*a* and the rear wall 2*b* are according to the illustrated embodiment connected to each other by means of a folded or welded portion 4. Near to the upper end thereof the front wall as well as the rear wall have relatively narrow openings or slots 5 for a purpose to be described. The front and rear walls 2*a*, 2*b* are connected to each other by means of expandable end portions 6*a*,6*b* which have been generated by folding along the lines 7*a*,7*c* (see also FIG. 3) to constitute bellows shaped end portions.

The holder further comprises a support member 8 against which the hamburger is intended to rest.

As appears from FIG. 1 the support member 8 is received in the container 1, which has then been widened from the original flat shape to the shape shown in FIG. 1. The walls 2*a*, 2*b* diverge upwardly which enables the introduction of a hamburger or the like into the container.

Figure 3:
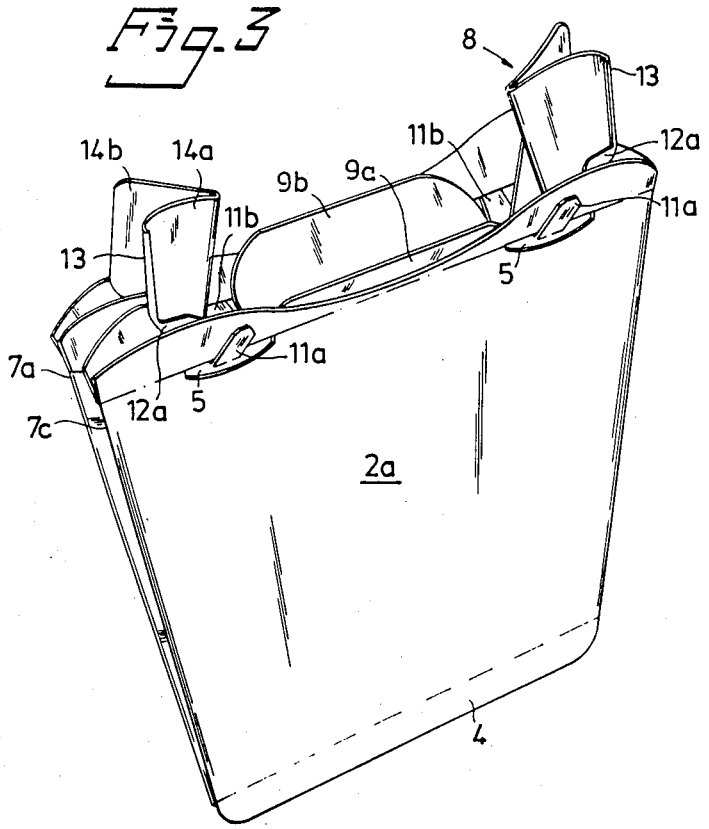
FIG. 3 shows in perspective the holder of FIGS. 1–2 with the support means in an upper, blocked position and FIG. 4 finally shows the support means in perspective.
Figure 4:
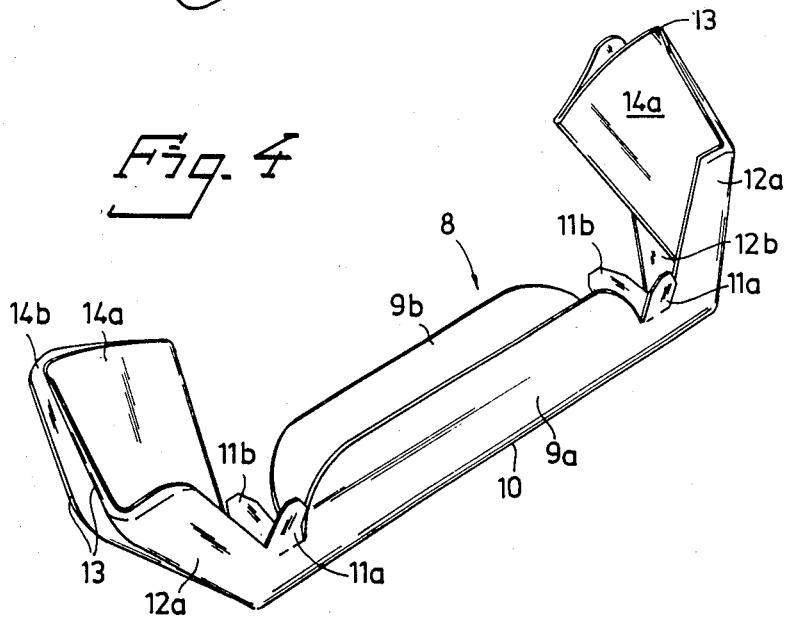

From FIG. 4 it appears that the support member 8 along the main part of its extension is substantially U- or V-shaped with the flanges 9*a*, 9*b* diverging upwardly. The flanges 9*a*, 9*b* join in a lower portion 10 which can consist of a web portion or a simple fold. The support member and also the container is made from a relatively thin and stiff and resilient material, preferably plastic with resilient properties. Adjacent to the ends of the flanges 9*a*,9*b* there extend flaps 11*a*,11*b* which are bent outwardly more than the flanges 9*a*, 9*b* for a purpose to be described. In the extension of the flanges 9*a*,9*b* respectively the flaps or tabs 11*a*,11*b* the support member has portions 12*a*,12*b* which via oblique folding lines 13 continue in V-shaped portions 14*a*,14*b* which connect the front and rear part of the support member. By this provision the end portions of the support member will have such a shape that they are guided in the substantially bellows shaped end portions of the container. As appears from FIG. 3 and FIG. 4 the end portions of the support member are extended upwardly such that they will bring forth an improved guiding in relation to the container 1.

The holder now described is used in the following manner: After having widened the mouth of the container for instance by slightly pressing the end portions thereof against each other the user inserts the support member 8 in the container 1 with the hand or by inserting the hamburger 15 or the like to be received in the holder. When fully depressed the support member will be located somewhat above the bottom of the container. The upper part of the hamburger will then project over the container and it will thus be possible to commence eating.

By the presence of the recesses 3 it is further possible to eat a relatively large part of the hamburger 15 before it has to be displaced upwardly. Such displacement is carried out manually by pressing the wall portions 2*a*, 2*b* towards each other in a zone situated below the upper edges of the flanges 9*a*,9*b* of the support member. Since the angle between the flanges 9*a*,9*b* is bigger than the angle between the extension of the wall portions 2*a*,2*b* there is generated between said wall portions and the flanges 9*a*,9*b* of the support member wedgeshaped spaces A, which contribute to give to the support member an upwardly directed movement when said wall portions 2*a*,2*b* are acted upon. Due to the fact that the flanges 9*a*,9*b* preferably are more heavily resilient than the wall portions 2*a*,2*b* and by influence of the weight of the hamburger and the resiliency of the flaps 11*a*,11*b* there is obtained a blocking effect when the pressure upon the walls ceases. By repeated pressings upon the container it is thus possible to successively and with adequate speed feed the support member and thereby also the hamburger upwards while eating it.

Eventually the support member reaches the upper end position shown in FIG. 3. In this position the resilient flaps 11*a*,11*b*, which have been under tension have reached the slots 5 and at that time they automatically snap into said slots and thereby prevent the support member from leaving the container.

In this position it is possible to use the support member as a closing cover or handle for the container 1. In this case the goods to be stored or transported is not placed on the support member but the goods is first introduced in the container and the support member is then applied as a closing cover or handle.

Of course it is also possible to provide the support member and the container with interengaging means for using the support member as a handle, but located upside down in relation to the position shown in the drawing.

In certain cases the support member may be in the shape of a relatively rigid box with sloping walls.

The container can also be made from an expanded heat insulating plastic material and have a bottom hole through which the support member may be displaced upwardly by means of a finger inserted through said hole.

The support member and the container in this case have interengaging means to give the support member a suitable friction during the displacement thereof and also to limit the displacement. By providing grooves in the container and arranging said grooves such that they extend from the bottom of the container to a point below the upper edge portion of the container and by providing the support member with projections fitting in said grooves this aim is reached by the fact that the container and/or the support member is resilient or has resilient portions.

I claim:

1. A holder for a food article and the like, comprising:

opposing front and rear walls, each of said front and rear walls having two side edges, a top edge and a bottom edge, said front and rear walls joined along said bottom edges and diverging upwardly therefrom;

first and second opposing side walls, each of said first and second side walls individually extending between said side edges on said front wall and said side edges on said rear wall, said side walls being folded into a bellows shape to enable said front and rear walls to diverge upward from said joined bottom edges, said side walls and said front and rear walls made from an elastically deformable sheet material and forming a container having an open end partially described by the top edges of said front and rear walls; and support means slidably positioned within said container for supporting the food article and for moving slidably upward within said container in response to inward pressure along said front and rear walls, said support means being concave in the direction of said open end and having two upwardly diverging resilient flanges connected along the base of support means, each of said flanges being bent outward, so that said support means is expandable when moving upward along said diverging front and rear walls toward said open end.

2. The holder as recited in claim 1 wherein said support means further comprises at least one resilient tab provided to project from said support means, and wherein said front and rear walls have at least one opening adjacent said top edges of said front and rear walls, said at least one opening being aligned to receive said at least one tab when said support means is pushed substantially adjacent said top edges, so that engagement of said at least one tab within said at least one opening prevents said support means from being unintentionally displaced out of the container.

3. The holder as recited in claim 2 wherein said support means has end portions shaped to fit into the bellows-shaped side walls of the container, said end portions having at least some part thereof extended upwardly.

4. The holder as recited in claim 2 wherein the front and rear walls of the container are joined substantially directly.

5. The holder as recited in claim 2 wherein the angle between the flanges of said support means and the rigidity of said flanges and container are such that a wedge action displaces said support means when the front and rear walls of the container are pressed against each other at or below the level of the support member, and wherein the displacement of said support means is arrested when the pressure ceases.

6. The holder as recited in claim 2 wherein the container is made from a substantially flat, thin sheet material, said sheet material being punched, folded and heat joined.

7. The holder as recited in claim 2, wherein said container and said support means are made of a relatively rigid, resilient and fluid resisting material having good sliding properties.

8. The holder as recited in claim 2 wherein said support means, said at least one tab and said at least one container wall opening are arranged such that said support means covers the open end of the container when said tab is snapped into said respective opening.

9. The holder as recited in claim 2 wherein said support means, said at least one tab and said at least one container wall opening are formed and arranged such that said support means forms a handle for said container when said tab is snapped into said respective opening.

10. The holder as recited in claim 1 wherein said support means further comprises a pluraltiy of resilient tabs provided to project from said support means, and wherein each of said front and rear walls have at least one opening adjacent said top edges of said front and rear walls, said openings being aligned to receive said plurality of tabs when said support means is pushed substantially adjacent said top edges, so that engagement of said tabs with said openings prevents said support means from being unintentionally displaced out of the container.

* * * * *